United States Patent [19]

Blanchard

[11] 4,406,632

[45] Sep. 27, 1983

[54] OUTBOARD MOTOR WITH DUAL TRIM AND TILT AXES

[75] Inventor: Clarence E. Blanchard, Kenosha, Wis.

[73] Assignee: Outboard Marine Corporation, Waukegan, Ill.

[21] Appl. No.: 167,337

[22] Filed: Jul. 9, 1980

[51] Int. Cl.[3] ..... B63H 21/26

[52] U.S. Cl. ..... 440/61; 248/642

[58] Field of Search ..... 440/58–63, 440/55, 56; 248/640–642, 643

[56] References Cited

U.S. PATENT DOCUMENTS

| | | | |
|---|---|---|---|
| 871,459 | 11/1907 | Thorsen | 248/643 X |
| 1,172,176 | 2/1916 | Stanley | 440/55 |
| 2,138,600 | 11/1938 | Harmon | 248/641 |
| 3,073,279 | 1/1963 | Moody | 440/62 |
| 3,581,702 | 6/1971 | Moberg | 440/61 |
| 3,648,645 | 3/1972 | Ezell | 440/63 |
| 3,839,986 | 10/1974 | Meyer et al. | 440/61 |
| 4,177,747 | 12/1979 | Pichl | 248/262 X |

*Primary Examiner*—Sherman D. Basinger
*Attorney, Agent, or Firm*—Michael, Best & Friedrich

[57] ABSTRACT

Discussed herein is an outboard motor comprising a transom bracket adapted to be fixed to a boat transom, a stern bracket having an upper end and extending downwardly from the upper end and including a first mounting arrangement located below the upper end at a first distance and second mounting arrangement located below the upper end at a second distance greater than the first distance, a tilt pivot pivotally connecting the transom bracket and the upper end of the stern bracket for swinging movement about a horizontal axis of the stern bracket relative to the transom bracket, a swivel bracket having a generally upright leg including opposite ends, a second pivot connected to the swivel bracket adjacent one of the ends of the upright leg and to one of the first and second mounting arrangements for affording swinging movement about a horizontal axis of the swivel bracket relative to the stern bracket, a hydraulic cylinder connected to the swivel bracket adjacent the other of the ends of the upright leg and to the other of the first and second mounting arrangements for adjustably locating the swivel bracket relative to the stern bracket about the second pivot, a propulsion unit supporting a propeller, and a steering pivot connected to the upright leg of the swivel bracket and to the propulsion unit for pivotally connecting the propulsion unit to the swivel bracket about a steering axis.

23 Claims, 3 Drawing Figures

OUTBOARD MOTOR WITH DUAL TRIM AND TILT AXES

RELATED APPLICATION

Attention is directed to the co-pending Myron T. Stevens application entitled "Outboard Motor With Elevated Horizontal Pivot Axis", Ser. No. 159,480, filed June 16, 1980 and now U.S. Pat. No. 4,355,986.

BACKGROUND OF THE INVENTION

The invention relates generally to marine propulsion devices and, more particularly, to outboard motors including a propulsion unit which includes an internal combustion engine and which is both steerable and tiltable.

More particularly, the invention relates to outboard motors which can be mounted on a relatively high, flush transom and which, when tilted to a raise position providing out-of-the-water accessibility to the propeller, do not travel forwardly of the rear surface of the boat transom.

Attention is directed to the Meyer et al U.S. Pat. No. 3,839,986 issued Oct. 8, 1974 and to the U.S. Pichl Pat. No. 4,177,747 issued Dec. 11, 1979.

SUMMARY OF THE INVENTION

The invention provides an outboard motor comprising transom bracket means adapted to be fixed to a boat transom, a stern bracket having an upper end and extending downwardly from the upper end and including first mounting means located below the upper end at a first distance and second mounting means located below the upper end at a second distance greater than the first distance, tilt means pivotally connecting the transom bracket means and the upper end of the stern bracket for swinging movement about a horizontal axis of the stern bracket relative to the transom bracket means, a swivel bracket having a generally upright leg including opposite ends, pivot means connected to the swivel bracket adjacent one of the ends of the upright leg and to one of the first and second mounting means for affording swinging movement about a horizontal axis of the swivel bracket relative to the stern bracket, means connected to the swivel bracket adjacent the other of the ends of the upright leg and to the other of the first and second mounting means for adjustable locating the swivel bracket relative to the stern bracket about the pivot means, a propulsion unit supporting a propeller, and means connected to the upright leg of the swivel bracket and to the propulsion unit for pivotally connecting the propulsion unit to the swivel bracket about a steering axis.

In one embodiment of the invention, the means for adjustably locating the swivel bracket relative to the stern bracket comprises an extensible hydraulic cylinder-piston assembly.

In one embodiment of the invention, the outboard motor further includes extensible means connected between the transom bracket means and the stern bracket for tilting the stern bracket relative to the transom bracket means about the upper horizontal axis.

In one embodiment of the invention, the propulsion unit includes a power head located above the means connecting the propulsion unit and the swivel bracket and below the tilt means.

In one embodiment of the invention, the outboard motor further includes means adapted to be fixed to the boat transom and engageable by said stern bracket for transmitting side loads to the boat transom.

In one embodiment in accordance with the invention, the means pivotally connecting the stern bracket and the transom bracket means is located rearwardly of the boat transom.

Other features and advantages of the embodiments of the invention will become known by reference to the following general description, claims and appended drawings.

IN THE DRAWINGS

Figure 1:
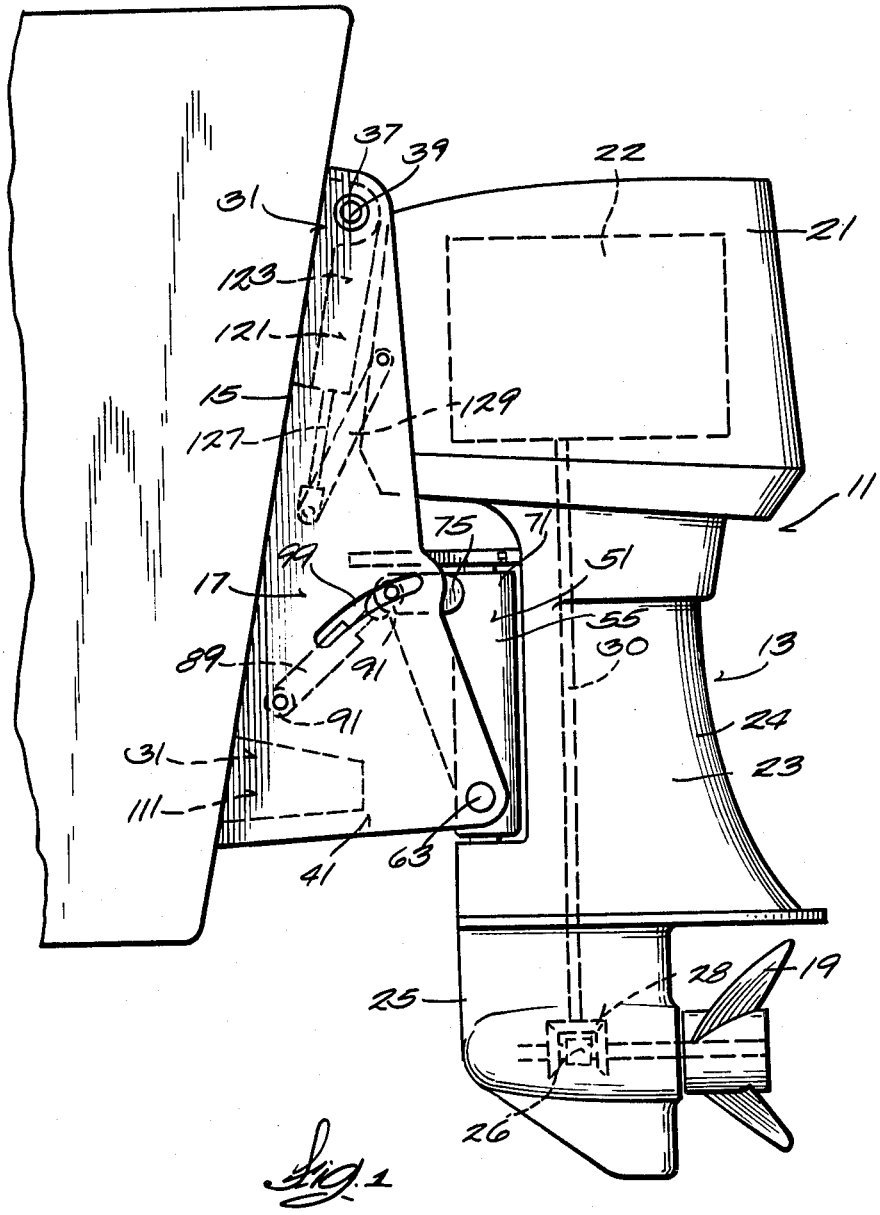
FIG. 1 is a fragmentary side elevational view of one embodiment of an outboard motor including various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 of the drawings is a marine propulsion device which is in the form of an outboard motor 11 including a tiltable and steerable propulsion unit 13 including a rotatably mounted propeller 19. The outboard motor 11 also includes means 17 for mounting the propulsion unit on a boat transom 15 so as, as will be explained more fully hereinafter, to permit tilting of the propulsion unit 13 from a normal running position with the propeller 19 submerged in water to a raised tilted position providing above water accessibility to the propeller 19 without causing any substantial movement of the propulsion unit 13 forwardly of the rear of the boat transom 15.

As is conventional, the propulsion unit 13 includes a power-head 21 provided with an internal combustion engine 22, together with a lower unit 23 which is fixed to the bottom of the power-head 21 and which includes a drive shaft housing 24 and a lower gear case or box 25 which supports a propeller shaft 26 carrying the propeller 19. The gear box 25 includes a suitable transmission 28 which connects the propeller shaft 26 to a drive shaft 30 which, in turn, is connected to the crankshaft of the internal combustion engine 22.

The means 17 for mounting the propulsion unit 13 for tiltable and swinging movement comprises transom bracket means 31 (see also FIG. 2) which is adapted to be fixed to the boat transom 15 and which can constitute a unitary member, or an assemblage of members, or separate pieces individually fixed to the rear surface of the boat transom 15 by any suitable means. The transom bracket means 31 includes a horizontally disposed enlargement 33 which is located rearwardly of the boat transom 15 and which includes a horizontal bore 35.

Pivotally connected to the enlargement 35 as by a pivot pin 37 extending through the bore 35, or by any other suitable means, is the upper end of a unitary stern bracket 41 which is accordingly tiltable relative to the boat transom 15 in a vertical plane about an upper horizontal axis 39 between a normal running position in which the stern bracket 41 engages the boat transom 15 for transmitting thereto propulsion thrust and a raised tilt position. The stern bracket 41 extends downwardly from the pivotal connection and can be of U-shape in horizontal cross-section including a laterally spaced pair of wing portions 43 connected by a laterally and vertically extending strengthening portion or web 45. If desired, a horizontally extending strengthening shelf 47 can extend between the wing portions 43 adjacent to the lower end thereof and preferably somewhat above the extreme lower end thereof.

As illustrated, the wing portions 43, at their lower ends, extend rearwardly to a considerably greater extent than at their upper ends with the rearward extent progressively diminishing from lower ends toward the upper ends.

The propulsion unit mounting means or arrangement 17 also includes a unitary swivel bracket 51 including a vertical leg 53 having upper and lower ends 55 and 57, respectively, and a vertical bore 59 extending therebetween.

The propulsion unit mounting means or arrangement 17 further includes means 61 connecting the swivel bracket 51 to the stern bracket 41 for swinging movement of the swivel bracket 51 relative to the stern bracket 41 in a vertical plane about a lower horizontal axis 63. While various arrangements can be employed, in the construction illlustrated in FIG. 1, such means comprises a pair of aligned bores 65 respectively extending in the lower rearward part of the laterally spaced wing portions 43 of the stern bracket 41, together with a pair of bosses 67 located between the wing portions 43 and extending oppositely from the lower end 57 of the vertical swivel bracket leg 53 and including threaded bores in alignment with the bores 65 in the wing portions 43, and suitable pivot means, such as threaded pins 69 (one shown) extending through the wing portion bores 65 and threaded into the bores in the bosses 67.

The propulsion unit mounting means or arrangement 17 also includes means for pivotally displacing the swivel bracket 51 about the lower horizontal axis 63 so as to enable trimming of the propulsion unit 13 into the proper position to maximize propulsion efficiency. While various arrangements can be employed, in the construction illustrated in FIG. 1, such means comprises an arm 71 projecting forwardly from the upper end 55 of the swivel bracket 51 between the wing portions 43, which arm 71 includes, at the forward end thereof, a bifurcated portion having spaced fingers 75 and aligned transverse bores 77 extending through the fingers 75.

The means for pivotally displacing the swivel bracket 51 also includes a hydraulic cylinder-piston 89 assembly including, at the opposite ends thereof, suitable eye structures 91. One of the eye structures 91 the cylinder-piston assembly 89 is pivotally connected, by any suitable means, to the laterally spaced wing portions 43 of the stern bracket 41. For instance, a hinge pin 93 extending through the eye structure 91 and fixed at its ends in the wing portions 43, can be employed.

The other eye structure 91 of the cylinder-piston assembly 89 is pivotally connected, by any suitable means, to the bifurcated forward part of the swivel bracket 51. For instance, a hinge pin 95 extending through the eye structure 91 and through the previously mentioned aligned bores 77, can be employed. In order to provide guidance for the path of the hinge pin 95 during extension and retraction of the cylinder-piston assembly 89, the hinge pin 95 can include ends 97 (one shown) guided in respective arcuate slots 99 provided in the laterally spaced wing portions 43 and extending about a common uniform radius from the lower horizontal axis 63.

Accordingly, extension and retraction of the cylinder-piston assembly 89 can be employed to vary the trim angle of the swivel bracket 51 and connected propulsion unit 13 about the lower horizontal axis 63 to obtain maximum propulsion efficiency.

The propulsion unit mounting means or arrangement 17 also includes means 111 for absorbing any side pressures which may be applied to the stern bracket 41. While various arrangements can be employed, in the illustrated construction, such means comprises a U-shaped bracket 113 which can be unitary with the aforementioned transom bracket means 31 or which can be separately mounted on the boat transom 15.

The bracket 113 includes two laterally spaced arms 115 which extend rearwardly below the lower edge of the stern bracket web 45 and below the horizontal strengthening shelf 47 and in inwardly adjacent relation to the inner surfaces of the stern bracket wing portions 43 for transmission thereto from the wing portions 43 of side loading from the stern bracket 41 without adversely affecting pivotal movement of the stern bracket 41 about its pivot in the absence of such loading.

The propulsion unit mounting means or arrangement 17 also includes means 121 for tilting the stern bracket relative to the transom bracket means 31 about the upper horizontal axis 39 so as to displace the propulsion unit 13 from the normal operating position to a raised tilt position providing above water accessibility to the propeller 19.

While various arrangements can be employed, in the illustrated construction, a tilt linkage is provided, which tilt linkage includes a tilt cylinder 123 which is fixedly mounted on, and forms a part of, the transom bracket means 31, which extends in generally parallel relation to the boat transom 15, and which includes a piston rod 127 which, at one end, is pivotally connected, by any suitable means, to a push link 129 which, at its opposite end, is pivotally connected, by any suitable means, to the wing portions 43 of the stern bracket 41. In the disclosed construction, the upper end of the link 129 is yoke shaped with two arms 131 which are respectively pivotally connected, as by one or more studs 133, to the wing portions 43. As the tilt cylinder is contracted, movement of the piston rod 127 tilts or pushes the stern bracket 41 and the accompanying propulsion unit 13 upwardly to the elevated or raised tilt position. Such upward tilting does not disturb the trim setting of the swivel bracket 51 and propulsion unit 13 relative to the stern bracket 41 and, upon repositioning of the stern bracket 41 in engagement with the boat transom 15, the trim setting of the propulsion unit will remain the same.

Propulsive thrust from the propulsion unit 13 is carried into the stern bracket 41 through the connection of the propulsion unit 13 with the swivel bracket 41 and through the connection of the swivel bracket 51 with the lower end of the stern bracket 41 and through the trim cylinder assembly 89 to the stern bracket 41. From the stern bracket 41, propulsive force is transmitted to the boat transom 15 by reason of engagement of the relatively elongated vertical forward edges 141 of the stern bracket 41 and web 45 against the flat rearward surface of the boat transom 15.

Figure 3:
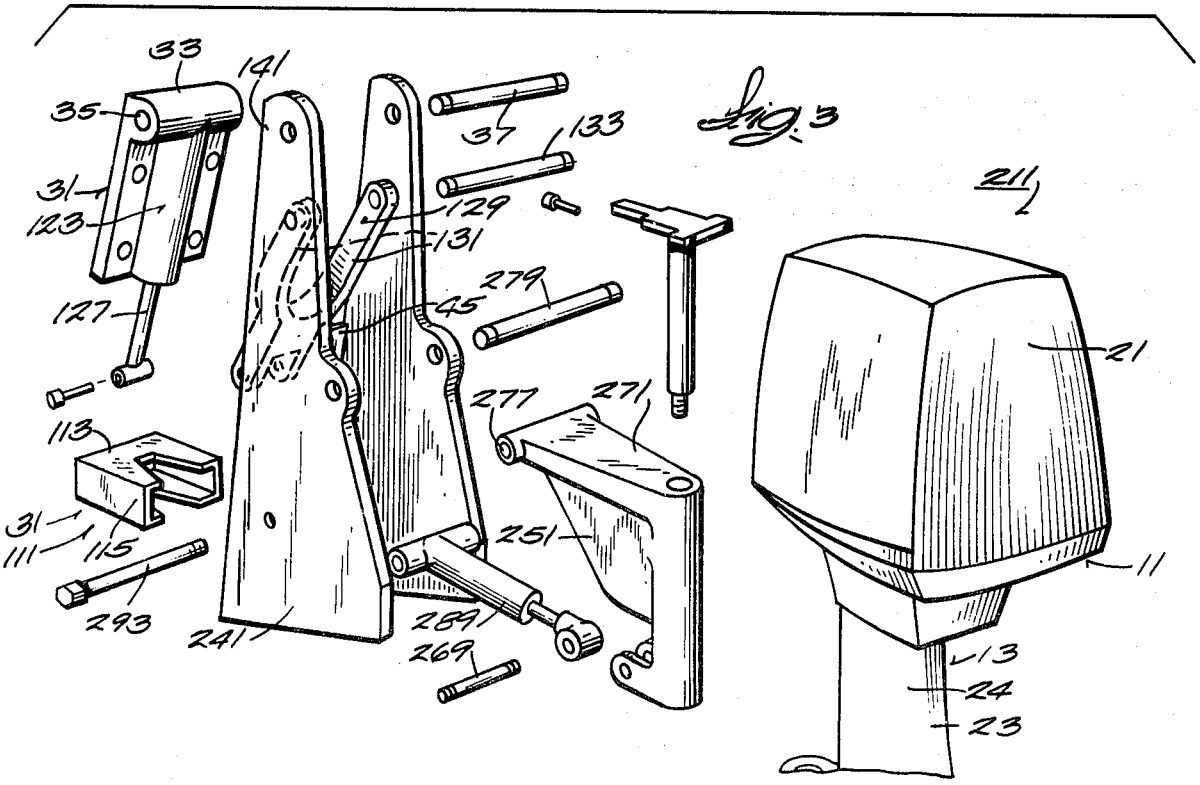
FIG. 3 is an exploded perspective view of another embodiment of an outboard motor including various of the features of the invention.

Shown in FIG. 3 is another embodiment of a marine propulsion device in the form of an outboard motor 211 which is similar to the outboard motor 11 shown in FIG. 1, except that the mounting of the swivel bracket 251 to the stern bracket 241 is reversed. More specifically, the upper end of the swivel bracket 251 includes a forwardly extending arm 271 having therein a transverse bore 277. Extending in the bore 277 is a pivot pin 279 which has its end supported in the spaced wing portions 243 of the stern bracket 251 so as to provide tilting movement of the swivel bracket 251 in a vertical plane relative to the stern bracket 241.

Figure 2:
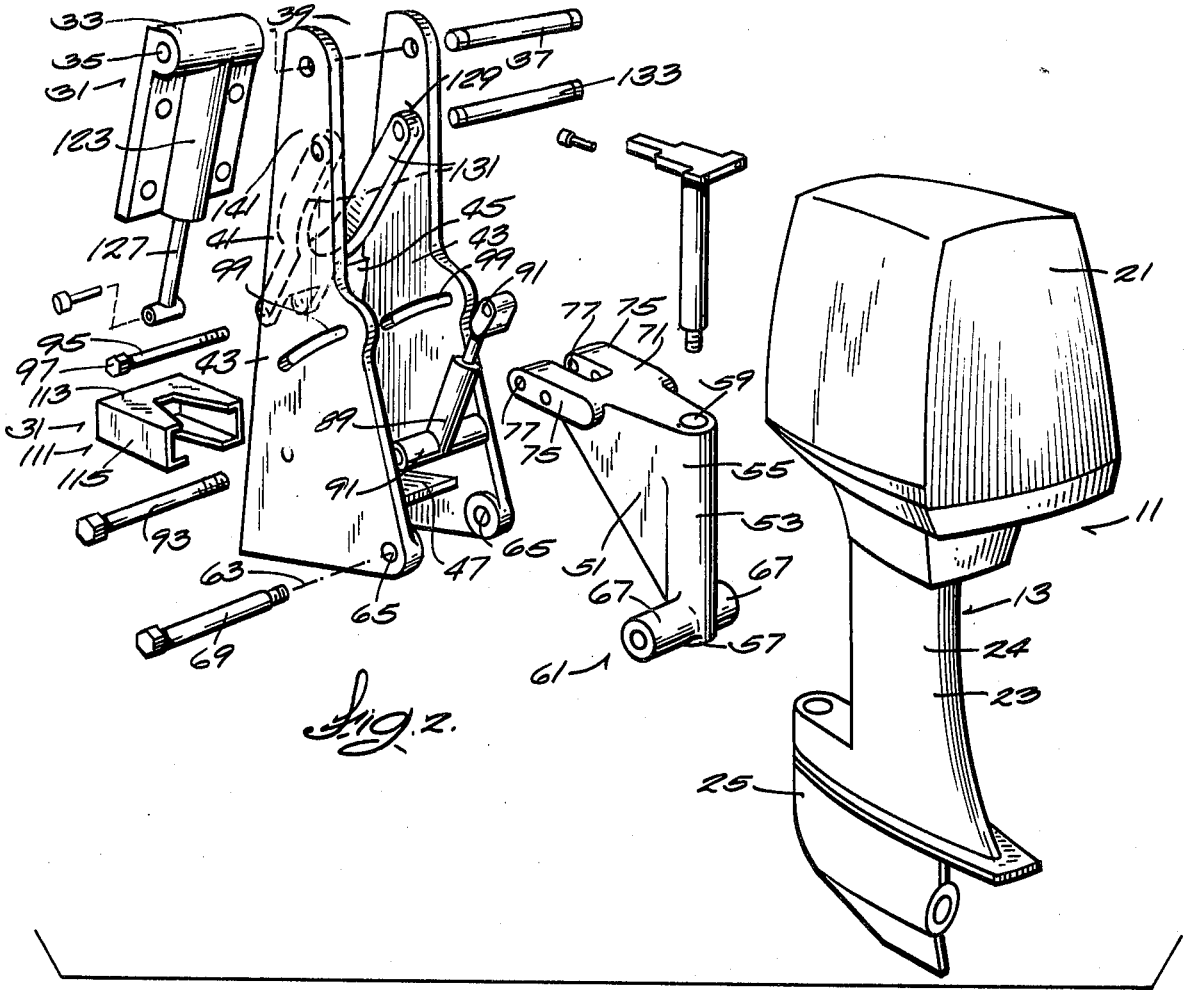
FIG. 2 is an exploded perspective view of the outboard motor shown in FIG. 1.

At its lower end, the swivel bracket 251 includes a pivotal connection, such as a pin 269, to a trim cylinder assembly 289 which, at its forward end, is pivotally connected, by any suitable means, such as the hinge pin 293, to the laterally spaced wing portions 243 of the stern bracket 241. In other respects, the arrangement shown in FIG. 2 is similar to the arrangement shown in FIG. 1.

Any suitable arrangement can be employed for steering the propulsion unit relative to the swivel bracket and therefore relative to the boat transom.

In both of the foregoing embodiments, a standard propulsion unit can be employed, which propulsion unit can be tilted out of the water to provide accessibility to the propeller by tilting of the stern bracket without causing the propulsion unit to travel forwardly of the surface of the transom. In addition, when the stern bracket is in the operating position in flush engagement with the rear of the transom, the swivel bracket and connecting propulsion unit can be trimmed by selective actuation of the trim cylinder assembly already referred to. Thus, the disclosed construction provides an arrangement for utilizing a standard outboard propulsion unit on a high transom boat while at the same time permitting vertical swinging movement of the propulsion unit so as to provide accessibility to the propeller, but without causing the propulsion unit to move forwardly of the transom. In addition, the propulsion unit can be trimmed to provide optimum propulsion efficiency independently of tilting operation.

Various of the features of the invention are set forth in the following claims.

I claim:

1. An outboard motor comprising transom bracket means adapted to be fixed to the transom of a boat, a unitary stern bracket having an upper end and including first mounting means located below said upper end at a first distance and second mounting means located below said upper end at a second distance greater than said first distance, tilt means pivotally connecting said transom bracket means and said upper end of said stern bracket for swinging movement about an upper horizontal axis of said stern bracket relative to said transom bracket means, a swivel bracket having a generally upright leg including opposite ends, pivot means directly pivotally connecting said swivel bracket adjacent one of said ends of said upright leg and one of said first and second mounting means for affording swinging movement of said swivel bracket relative to said stern bracket about a lower horizontal axis spaced below said upper horizontal axis, means connected to said swivel bracket adjacent the other of said ends of said upright leg and to said other of said first and second mounting means for adjustably locating said swivel bracket relative to said stern bracket about said pivot means, a propulsion unit supporting a propeller, and means connected to said upright leg of said swivel bracket and to said propulsion unit for pivotally connecting said propulsion unit to said swivel bracket about a generally vertical axis.

2. An outboard motor in accordance with claim 1 wherein said means for adjustably locating said swivel bracket relative to said stern bracket comprises an extensible hydraulic cylinder-piston assembly.

3. An outboard motor in accordance with claim 1 and further including extensible means connected between said transom bracket means and said stern bracket for tilting said stern bracket relative to said transom bracket means.

4. An outboard motor in accordance with claim 1 wherein said propulsion unit includes a power head located above said means connecting said propulsion unit and said swivel bracket and below said tilt means.

5. An outboard motor in accordance with claim 1 wherein said transom bracket means includes means engageable with said stern bracket for receiving therefrom side loading.

6. An outboard motor in accordance with claim 1 wherein said stern bracket includes a pair of laterally spaced wing portions.

7. An outboard motor in accordance with claim 6 wherein said stern bracket also includes a laterally extending portion connecting said wing portions.

8. An outboard motor in accordance with claim 1 wherein said means pivotally connecting said stern bracket and said transom bracket means is located rearwardly of the boat transom.

9. An outboard motor comprising transom bracket means adapted to be fixed to the transom of a boat, a stern bracket having an upper end and extending downwardly from said upper end and including first mounting means located below said upper end at a first distance and second mounting means located below said upper end at a second distance greater than said first distance, tilt means pivotally connecting said transom bracket means and said upper end of said stern bracket for swinging movement about an upper horizontal axis of said stern bracket relative to said transom bracket means, a swivel bracket having a generally upright leg including opposite ends, pivot means connected to said swivel bracket adjacent one of said ends of said upright leg and to one of said first and second mounting means for affording swinging movement of said swivel bracket relative to said stern bracket about a lower horizontal axis spaced below said upper horizontal axis, means connected to said swivel bracket adjacent the other of said ends of said upright leg and to said outer of said first and second mounting means for adjustably locating said swivel bracket relative to said stern bracket about said pivot means, a propulsion unit supporting a propeller and means extending vertically through said upright leg of said swivel bracket so as to pivotally connect said propulsion unit to said swivel bracket about a generally vertical axis.

10. An outboard motor comprising transom bracket means adapted to be fixed to the transom of a boat, a member pivotally connected to said transom bracket means for swinging movement of said member relative to said transom bracket means about a first horizontal axis, said member having a lower end, a swivel bracket pivotally connected to said member for swinging movement of said swivel bracket relative to said member about a second horizontal axis located in spaced relation below said first horizontal axis and such that said swivel bracket is only pivotal relative to said member about said second horizontal axis, a propulsion unit supporting a thrust producing element and being pivotally connected to said swivel bracket about a steering axis transverse to said horizontal axes and such that said propulsion unit is only pivotable relative to said swivel bracket about said steering axis, and means on said transom bracket means and on said member lower end for engagement therebetween so as to enable transmission of side forces from said lower end of said member to said transom bracket means.

11. An outboard motor comprising transom bracket means adapted to be fixed to the transom of a boat, a propulsion unit supporting a thrust producing element, and means connecting said propulsion unit to said transom bracket means so as to provide for pivotal steering movement of said propulsion unit relative to said transom bracket means about a steering axis, and for pivotal trimming movement of said propulsion unit relative to said transom bracket means through a range of operating positions and about a trim axis, and for pivotal tilting movement of said propulsion unit relative to said transom bracket means about a tilt axis which is located rearwardly of the transom and which is spaced above said trim axis, said connecting means including a stern bracket pivotally connected to said transom bracket means about said tilt axis, said stern bracket including a lower end, and a swivel bracket pivotally connected to said stern bracket about said trim axis and connected to said propulsion unit about said steering axis such that said propulsion unit only pivots relative to said swivel bracket about said steering axis and such that said swivel bracket only pivots relative to said stern bracket about said trim axis, and means on said transom bracket means and on said stern bracket lower end for engagement therebetween so as to enable transmission of side forces from said lower end of said stern bracket to said transom bracket means.

12. An outboard motor comprising transom bracket means adapted to be fixed to the transom of a boat, a member pivotally connected to said transom bracket means for swinging movement of said member relative to said transom bracket means about a first horizontal axis, a unitary swivel bracket pivotally connected to said member for swinging movement of said swivel bracket relative to said member about a second horizontal axis which passes through said swivel bracket and through said member and which is located in spaced relation below said first horizontal axis and such that said swivel bracket is only pivotal relative to said member about said second horizontal axis, and a propulsion unit supporting a thrust producing element and being pivotally connected to said swivel bracket about a steering axis transverse to said horizontal axes and such that said propulsion unit is only pivotable relative to said swivel bracket about said steering axis.

13. An outboard motor comprising transom bracket means adapted to be fixed to the transom of a boat, a propulsion unit supporting a thrust producing element, and means connecting said propulsion unit to said transom bracket means so as to provide for pivotal steering movement of said propulsion unit relative to said transom bracket means about a steering axis, and for pivotal trimming movement of said propulsion unit relative to said transom bracket means through a range of operating positions and about a trim axis, and for pivotal tilting movement of said propulsion unit relative to said transom bracket means about a tilt axis which is located rearwardly of the transom and which is spaced above said trim axis, said connecting means including a stern bracket pivotally connected to said transom means about said tilt axis, and a unitary swivel bracket pivotally connected to said stern bracket about said trim axis and connected to said propulsion unit about said steering axis such that said trim axis passes through said swivel bracket and said stern bracket and such that said propulsion unit only pivots relative to said swivel bracket about said steering axis and such that said swivel bracket only pivots relative to said stern bracket about said trim axis.

14. An outboard motor comprising transom bracket means adapted to be fixed to the transom of a boat, a member pivotally connected to said transom bracket means for swinging movement of said member relative to said transom bracket means about a first horizontal axis, a unitary swivel bracket pivotally connected to said member for swinging movement of said swivel bracket relative to said member about a second horizontal axis which passes through each of said member and said swivel bracket and which is located in spaced relation below said first horizontal axis and such that said swivel bracket is only pivotal relative to said member about said second horizontal axis, a propulsion unit supporting a thrust producing element and pivotally connected to said swivel bracket about a steering axis transverse to said horizontal axes and such that said propulsion unit is only pivotable relative to said swivel bracket about said steering axis, a first hydraulic cylinder-piston assembly extending between and connecting said transom bracket means and said member for controlling pivotal movement therebetween, and a second hydraulic cylinder-piston assembly extending between and connecting said member and said swivel bracket for controlling pivotal movement therebetween and for transmitting propulsive thrust from said swivel bracket to said member.

15. An outboard motor comprising transom bracket means adapted to be fixed to the transom of a boat, a propulsion unit supporting a thrust producing element, and means connecting said propulsion unit to said transom bracket means so as to provide for pivotal steering movement of said propulsion unit relative to said transom bracket means about a steering axis, and for pivotal trimming movement of said propulsion unit relative to said transom bracket means through a range of operating positions and about a trim axis, and for pivotal tilting movement of said propulsion unit relative to said transom bracket means about a tilt axis which is located rearwardly of the transom and which is spaced above said trim axis, said connecting means including a stern bracket pivotally connected to said transom bracket means about said tilt axis, a unitary swivel bracket pivotally connected to said stern bracket about said trim axis and connected to said propulsion unit about said steering axis such that said trim axis extends through each of said swivel bracket and said stern bracket and such that said propulsion unit only pivots relative to said swivel bracket about said steering axis and such that said swivel bracket only pivots relative to said stern bracket about said trim axis, a first hydraulic cylinder-piston assembly extending between and connected to said transom bracket means and said stern bracket for controlling pivotal movement therebetween, and a second hydraulic cylinder-piston assembly extending between and connecting said stern bracket and said swivel bracket for controlling pivotal movement therebetween and for transmitting propulsive thrust from said swivel bracket to said stern bracket.

16. An outboard motor comprising transom bracket means adapted to be fixed to the transom of a boat, a member pivotally connected to said transom bracket means for swinging movement of said member relative to said transom bracket means about a first horizontal axis, said member having a lower end, a swivel bracket pivotally connected to said member for swinging movement of said swivel bracket relative to said member about a second horizontal axis located in spaced relation below said first horizontal axis and such that said swivel bracket is only pivotal relative to said member about said second horizontal axis, a propulsion unit supporting a thrust producing element and pivotally connected to said swivel bracket about a steering axis transverse to said horizontal axes and such that said propulsion unit is only pivotable relative to said swivel bracket about said steering axis, a first hydraulic cylinder-piston assembly extending between and connecting said transom bracket means and said member for controlling pivotal movement therebetween, a second hydraulic cylinder-piston assembly extending between and connecting said member and said swivel bracket for controlling pivotal movement therebetween, means on said transom bracket means and on said member lower end for engagement therebetween so as to enable transmission of side forces from said lower end of said member to said transom bracket means, and means on said member lower end for transmitting propulsive thrust from said lower end of said member to the boat transom.

17. An outboard motor comprising transom bracket means adapted to be fixed to the transom of a boat, a propulsion unit supporting a thrust producing element, and means connecting said propulsion unit to said transom bracket means so as to provide for pivotal steering movement of said propulsion unit relative to said transom means about a steering axis, and for pivotal trimming movement of said propulsion unit relative to said transom bracket means through a range of operating positions and about a trim axis, and for pivotal tilting movement of said propulsion unit relative to said transom bracket means about a tilt axis which is located rearwardly of the transom and which is spaced above said trim axis, said connecting means including a stern bracket pivotally connected to said transom bracket means about said tilt axis, said stern bracket including a lower end, a swivel bracket pivotally connected to said stern bracket about said trim axis and connected to said propulsion unit about said steering axis such that said propulsion unit only pivots relative to said swivel bracket about said steering axis and such that said swivel bracket only pivots relative to said stern bracket about said trim axis, a first hydraulic cylinder-piston assembly extending between and connected to said transom bracket means and said stern bracket for controlling pivotal movement therebetween, a second hydraulic cylinder-piston assembly extending between and connecting said stern bracket and said swivel bracket for controlling pivotal movement therebetween, means on said transom bracket means and on said stern bracket lower end for engagement therebetween so as to enable transmission of side forces from said lower end of said stern bracket to said transom bracket means, and means on said stern bracket lower end for transmitting propulsive thrust from said lower end of said stern bracket to the boat transom.

18. An outboard motor comprising transom bracket means adapted to be fixed to the transom of a boar, a member pivotally connected to said transom bracket means for swinging movement of said member relative to said transom bracket means about a first horizontal axis, a swivel bracket having a first leg extending fore-and-aft with a forward end and a rearward end and having a second leg extending generally vertically from said rearward end of said first leg, said forward end of said swivel bracket first leg being pivotally connected to said member for swinging movement of said swivel bracket relative to said member about a second horizontal axis which passes through said forward end of said swivel bracket first leg and through said member and which is located in spaced relation below said first horizontal axis and such that said swivel bracket is only pivotal relative to said member about said second horizontal axis, and a propulsion unit including a thrust producing element driven by said drive shaft, said propulsion unit being pivotally connected to said second leg of said swivel bracket about a steering axis which is transverse to said horizontal axes and such that said propulsion unit is only pivotable relative to said swivel bracket about said steering axis.

19. An outboard motor comprising transom bracket means adapted to be fixed to the transom of a boat, a propulsion unit including a thrust producing element, and means connecting said propulsion unit to said transom bracket means so as to provide for pivotal steering movement of said propulsion unit relative to said transom bracket means about a steering axis, and for pivotal trimming movement of said propulsion unit relative to said transom bracket means through a range of operating positions and about a trim axis, and for pivotal tilting movement of said propulsion unit relative to said transom bracket means about a tilt axis which is located rearwardly of the transom and which is spaced above said trim axis, said connecting means including a stern bracket pivotally connected to said transom bracket means about said tilt axis, and a swivel bracket having a first leg extending fore-and-aft with a forward end and a rearward end and having a second leg extending generally vertically from said rearward end of said first leg, said forward end of said swivel bracket first leg being pivotally connected to said stern bracket about said trim axis such that said trim axis passes through said forward end of said swivel bracket first leg and through said stern bracket and such that said swivel bracket only pivots relative to said stern bracket about said trim axis, and said second leg of said swivel bracket being pivotally connected to said propulsion unit about said steering axis such that said propulsion unit only pivots relative to said swivel bracket about said steering axis.

20. An outboard motor comprising a transom bracket means adapted to be fixed to the transom of a boat, a member pivotally connected to said transom bracket means for swinging movement of said member relative to said transom bracket means about a first horizontal axis, a swivel bracket having a first leg extending fore-and-aft with a forward end and a rearward end and having a second leg extending generally vertically from said rearward end of said first leg, said forward end of said swivel bracket first leg being pivotally connected to said member for swinging movement of said swivel bracket relative to said member about a second horizontal axis which passes through said forward end of said swivel bracket first leg and through said member and which is located in spaced relation below said first horizontal axis and such that said swivel bracket is only pivotal relative to said member about said second horizontal axis, a propulsion unit supporting a thrust producing element and pivotally connected to said second leg of said swivel bracket about a steering axis transverse to said horizontal axes and such that said propulsion unit is only pivotable relative to said swivel bracket about said steering axis, a first hydraulic cylinder-piston assembly extending between and connecting said transom bracket means and said member for controlling pivotal movement therebetween, and a second hydraulic cylinder-piston assembly extending between and connecting said member and said swivel bracket for controlling pivotal movement therebetween.

21. An outboard motor comprising transom bracket means adapted to be fixed to the transom of a boat, a propulsion unit supporting a thrust producing element, and means connecting said propulsion unit to said transom bracket means so as to provide for pivotal steering movement of said propulsion unit relative to said transom bracket means through a range of operating positions and about a trim axis, and for pivotal tilting movement of said propulsion unit relative to said transom bracket means about a tilt axis which is located rearwardly of the transom and which is spaced above said trim axis, said connecting means including a stern bracket pivotally connected to said transom bracket means about said tilt axis, a swivel bracket having a first leg extending fore-and-aft with a forward end and a rearward end and having a second leg extending generally vertically from said rearward end of said first leg, said forward end of said swivel bracket first leg being pivotally connected to said stern bracket about said trim axis such that said trim axis extends through said forward end of said swivel bracket first leg and through said stern bracket and such that said swivel bracket only pivots relative to said stern bracket about said trim axis, and said second leg of said swivel bracket being pivotally connected to said propulsion unit about said steering axis such that said propulsion unit only pivots relative to said swivel bracket about said steering axis, a first hydraulic cylinder-piston assembly extending between and connected to said transom bracket means and said stern bracket for controlling pivotal movement therebetween, and a second hydraulic cylinder-piston assembly extending between and connecting said stern bracket and said swivel bracket for controlling pivotal movement therebetween.

22. An outboard motor comprising transom bracket means adapted to be fixed to the transom of a boat, a member pivotally connected to said transom bracket means for swinging movement of said member relative to said transom bracket means about a first horizontal axis, said member having a lower end, a swivel bracket having a first leg extending fore-and-aft with a forward end and a rearward end and having a second leg extending generally vertically from said rearward end of said first leg, said forward end of said swivel bracket first leg being pivotally connected to said member for swinging movement of said swivel bracket relative to said member about a horizontal axis which passes through said forward end of said swivel bracket first leg and through said member and which is located in spaced relation below said first horizontal axis and above said lower end of said member and such that said swivel bracket is only pivotal relative to said member about said second horizontal axis, a propulsion unit supporting a thrust producing element and being pivotally connected to said second leg of said swivel bracket about a steering axis transverse to said horizontal axes and such that said propulsion unit is only pivotable relative to said swivel bracket about said steering axis, and means on said member lower end for transmitting thrust from said propulsion unit to the boat transom.

23. An outboard motor comprising transom bracket means adapted to be fixed to the transom of a boat, a propulsion unit supporting a thrust producing element, means connecting said propulsion unit to said transom bracket means so as to provide for pivotal steering movement of said propulsion unit relative to said transom bracket means about a steering axis, and for pivotal trimming movement of said propulsion unit relative to said transom bracket means through a range of operating positions and about a trim axis, and for pivotal tilting movement of said propulsion unit relative to said transom bracket means about a tilt axis which is located rearwardly of the transom and which is spaced above said trim axis, said connecting means including a stern bracket pivotally connected to said transom bracket means about said tilt axis, said stern bracket having a lower end located below said trim axis, and a swivel bracket having a first leg extending fore-and-aft with a forward end and a rearward end and having a second leg extending generally vertically from said rearward end of said first leg, said forward end of said swivel bracket first leg being pivotally connected to said stern bracket about said trim axis such that said trim axis passes through said forward end of said swivel bracket first leg and through said stern bracket and said second leg of said swivel bracket being pivotally connected to said propulsion unit about said steering axis such that said propulsion unit only pivots relative to said swivel bracket about said steering axis and such that said swivel bracket only pivots relative to said stern bracket about said trim axis, and means on said stern bracket lower end for transmitting thrust from said propulsion unit to the boat transom.

* * * * *

UNITED STATES PATENT AND TRADEMARK OFFICE

CERTIFICATE OF CORRECTION

PATENT NO. : 4,406,632
DATED : September 27, 1983
INVENTOR(S) : Clarence E. Blanchard It is certified that error appears in the above—identified patent and that said Letters Patent is hereby corrected as shown below:

In column 9, line 42 before "means", insert --bracket--.

In column 10, line 5, delete "boar", insert --boat--.

Signed and Sealed this

*Fifth* Day of *June 1984*

[SEAL]

*Attest:*

GERALD J. MOSSINGHOFF

*Attesting Officer*

*Commissioner of Patents and Trademarks*